US006435351B1

(12) United States Patent
Gibb

(10) Patent No.: US 6,435,351 B1
(45) Date of Patent: Aug. 20, 2002

(54) DISPLAY SHIPPER

(75) Inventor: Jeffrey S. Gibb, Boonton, NJ (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 09/637,177

(22) Filed: Aug. 11, 2000

(51) Int. Cl.[7] ..... B65D 5/50; B65D 17/28

(52) U.S. Cl. ..... 206/736; 206/774; 229/235; 229/237; 229/242

(58) Field of Search ..... 206/736, 746, 206/774; 229/237, 240–242, 235

(56) References Cited

U.S. PATENT DOCUMENTS 1,905,992 A * 4/1933 Bogren ..... 229/242
3,315,875 A * 4/1967 Praetorius ..... 229/242
3,669,251 A * 6/1972 Phillips ..... 229/237
3,961,706 A * 6/1976 Roccaforte et al. ..... 206/736
4,058,206 A * 11/1977 Morse et al. ..... 229/241
4,113,100 A * 9/1978 Soja et al. ..... 229/235
4,191,288 A 3/1980 Hofstad
4,553,666 A * 11/1985 Gullikson ..... 229/240
4,605,128 A * 8/1986 Rieke ..... 229/242
5,035,323 A 7/1991 Daniels et al.
5,167,324 A * 12/1992 Miller ..... 229/235
5,474,171 A 12/1995 Niesen et al.
5,881,884 A * 3/1999 Podosek ..... 206/774
6,073,833 A * 6/2000 Desrosiers et al. ..... 229/237
6,209,786 B1 * 4/2001 Yelton et al. ..... 229/241

* cited by examiner

*Primary Examiner*—Bryon P. Gehman
(74) *Attorney, Agent, or Firm*—Thomas A. Marcoux

(57) ABSTRACT

A shipping and display case having a unique series of perforated tears and cuts for opening the case. The case may have a conventional box shape, including front, back, left, right, top and bottom panels, and the case is provided with a perforated tear line that is used to open the case. The score line is formed by a multitude of perforations or slits; and the slits in selected portions of the tear line are substantially longer than the slits in the rest of the tear line. In particular, in the portions of the tear line that cross over left and right front edges of the case, and in selected angled portions of the tear line, the slits are substantially longer than the slits in the rest of the tear line. These longer slits make it easier to cut or tear through areas where it is normally difficult to tear cleanly.

14 Claims, 3 Drawing Sheets

DISPLAY SHIPPER

BACKGROUND OF THE INVENTION

This invention generally relates to shipping and display cases, and to blanks for making such cases.

Shipping and display cases have the dual purpose of containing or holding articles both while the articles are being shipped and while the articles are being displayed, typically at a retail store, convenience store, drug store, club store or mass merchandiser such as a grocery store. The use of these cases has the advantage of eliminating the need at the retail outlet to remove the individual articles from the case and to place those articles individually on shelves or racks so that the articles are available to the consumer. Instead, when a shipping and display case is used, it is only necessary at the retail store to open the case and to put the case in a location accessible to the consumer.

With many shipping/display cases, it is desirable or necessary that the cases be opened in a particular manner so that the articles inside the cases are displayed, or made accessible, in an appropriate or preferred way. Commonly, these cases are provided with a combination of score lines and cuts to enable or to facilitate opening the cases in the desired manner.

Providing cases with such perforated scoring lines, however, is complicated by the fact that perforations tend to reduce the structural integrity of the cases. As a practical matter, this may reduce the compressive strength of the cases. This compressive strength is important because shipping/display cases are often stacked one upon another in order to conserve space and to utilize efficiently warehouse and cargo space. In addition, perforations may open or rupture prematurely during shipping and handling of the cases, subjecting the articles inside the cases to loss or damage, prior to delivery to the customer.

Because of the above-considerations, it is often difficult to design a shipping/display case that can be readily and easily cut or torn open in a particular way and that also has the desired structural integrity.

SUMMARY OF THE INVENTION

An object of this invention is to improve display/shipper cases.

Another object of the present invention is to provide an improved stadium style display shipper.

A further object of this invention is to provide a display shipper with a series of perforations that allows complete access to the front packages of the, but that does not significantly affect the structural integrity of the case.

These and other objectives are attained with a shipping and display case having a uniquely designed series of perforations and cuts for opening the case. The case may have a conventional box shape, including front, back, left, right, top and bottom panels, and the case is provided with a perforated tear line that is used to open the case. The tear line is formed by a multitude of perforations or slits; and the slits in selected portions of the tear line are substantially longer than the slits in the rest of the tear line. This slit/score pattern is adjusted to afford ease of opening by the customer or sales representative. In particular, in the portions of the tear line that cross over left and right front edges of the case, and in selected angled portions of the tear line, the slits are substantially longer than the slits in the rest of the tear line. These longer slits make it easier to cut the tear line through areas where it is normally difficult to tear cleanly. In addition, the display shipper of the present invention can be easily run on existing case packing equipment, making it easily adaptable (?) to the manufacturing plants, allowing them ease of transition into this case as promotions, in-outs or customer requests are scheduled.

The design of the present invention achieves benefits associated with the use of tear lines without the normal associated disadvantages. In particular, the use of longer slits in selected portions of the tear line allows the tear line to be easily, cleanly cut or torn. At the same time, the use of shorter slits through most of the tear line results in a tear line that does not significantly reduce the structural integrity of the case, and that is resistant to premature or inadvertent opening.

Further benefits and advantages of the invention will become apparent from a consideration of the following detailed description, given with reference to the accompanying drawings, which specify and show preferred embodiments of the invention.

DETAILED DESCRIPTION OF THE PREFERRED EMBODIMENTS

Figure 1:
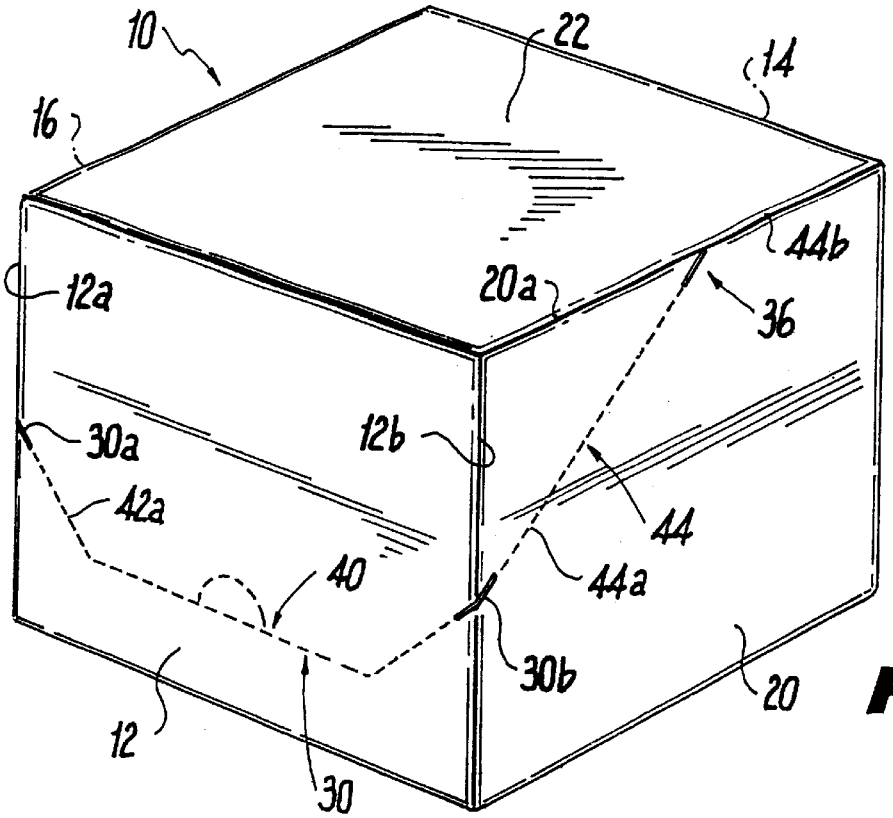
FIGS. 1 and 2 are right front and left front orthogonal views, respectively, of a shipping and display case embodying this invention.
Figure 2:
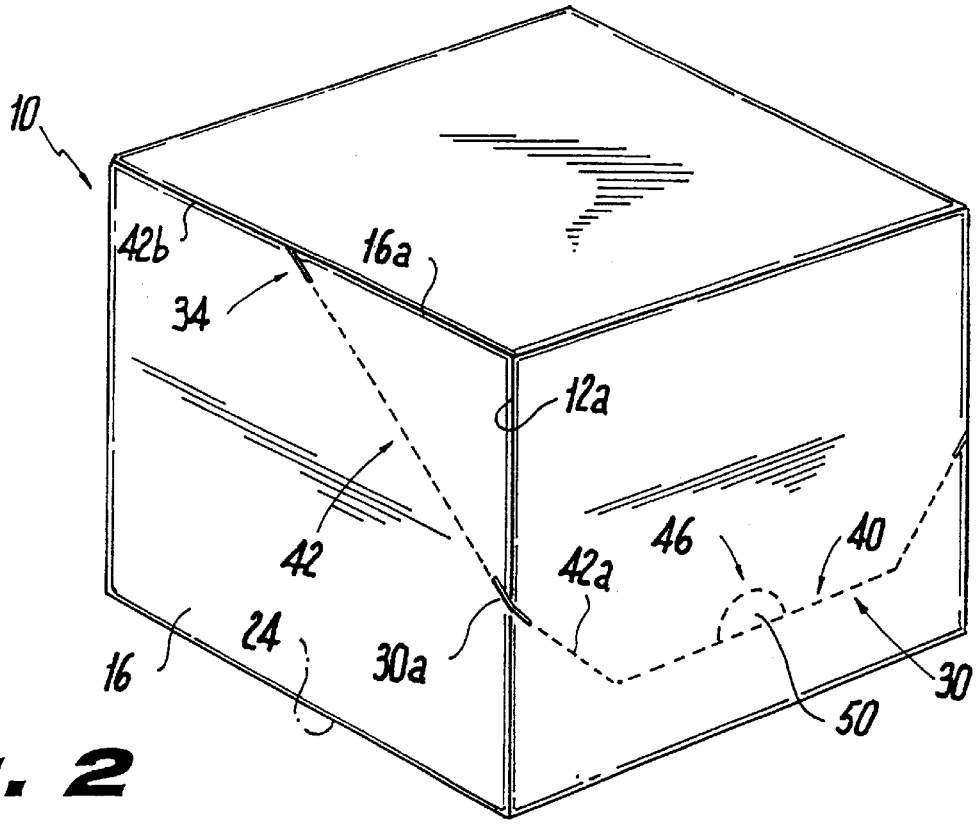
Figure 3:
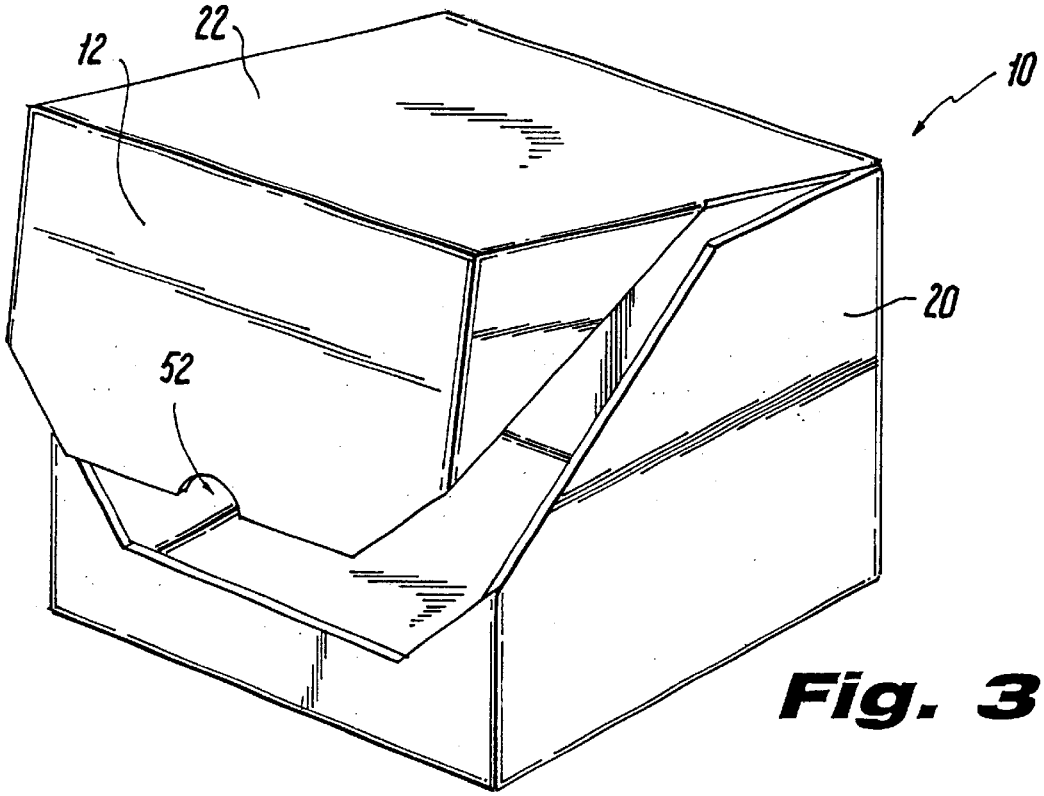
FIG. 3 shows the case of FIGS. 1 and 2 as a top portion of the case is being removed.

FIGS. 1 and 2 show a display shipper case 10 embodying this invention. Case has a conventional box shape, front panel 12, back panel 14, left panel 16, right panel 20, top panel 22 and bottom panel 24. Case 10 is provided with a perforated tear line 30 that is used to open the case, from the position shown in FIGS. 1 and 2, through the intermediate position of FIG. 3, and to the position shown in FIG. 4. In this latter position, a top portion of the case has been completely removed, resulting in a shape or configuration referred to as stadium style. As clearly apparent from FIG. 4, when the case is in this open position, the articles 32 in the case are readily visible and easily accessible.

Tear line 30 is formed by a multitude of perforations or slits; and in accordance with the present invention, the slits in selected portions of the tear line are substantially longer than the slits in the rest of the tear line. In particular, in the portions 30*a* and 30*b* of the tear line that cross over the left and right front edges 12*a* and 12*b* of the case, and in angled portions 34 and 36 of the tear line, the slits are substantially longer than the slits in the rest of the tear line. These longer slits make it easier to cut or open the tear line through these areas, where it is normally difficult to tear cleanly.

More specifically, with the preferred embodiment of case 10 shown in the drawings, tear line 30 includes center section 40, left section 42 and right section 44. Left section 42 includes first segment 42*a*, second segment 42*b* and angled portion 34; and right section 44 includes first segment 44*a*, second segment 44*b* and angled portion 36. Center section 40 is formed in front panel 12, and this line section is parallel to and slightly above the bottom edge of that front panel. Left line section 42 extends leftwardly upwardly from the left end of the center section 40, across left side edge 12*a* and across left side panel 16. Line segment 42*a* continues across side panel 16 and to top left edge 16*a* of the case, and line segment 42*b* then extends leftward, directly on edge 16*a*. Angular portion 34 of line section 42 extends between and connects together line segments 42*a* and 42*b*.

Right line section 44 generally mirrors left line section 42. In particular, right line section 44 extends rightwardly upwardly from the right end of center line section 40, across right side edge 12*b* and across the right side panel 20. Line section 44, specifically segment 44*a* thereof, continues across side panel 20 and to top right edge 20*a* of the case, and line segment 44*b* then extends rightward, directly on that edge 20*a*. Angular portion 36 of line section 44 extends between and connects together line segments 44*a* and 44*b*. Preferably, it may be noted, tear line 30 also extends across the back top edge of case 10 to facilitate completely cutting or tearing away top flaps of the case.

As mentioned above, in the portions 30*a* and 30*b* of the tear line 30 that cross over left and right front edges 12*a* and 12*b* of case, and in the angled portions 34 and 36 of the tear line, the slits of the tear line are substantially longer than the slits in the rest of the tear line. As one example, in each of these selected portions of the tear line, the tear line may consist of a single slit. Also, along central section 40 and line segments 42*a* and 44*a*, the slits of the tear line may be one-half inch long and spaced apart three-sixteenths of an inch; and in line segments 42*b* and 44*b*, the slits may be three-eights of an inch long and spaced apart one-quarter inch. Other specific dimensions may be used in the practice of this invention, however.

The embodiment of case 10 shown in the drawings includes a second tear line 46 that is used to form a gripping area that can be used by a person to grip panel 12 to help tear the case along tear line 30. More specifically, both ends of this second tear line 46 are connected to tear line 30, so that tear lines 30 and 46 bound a defined area 50. This area can be torn, cut or punched out of panel 12 to provide a gripping area 52. A person can then grip front panel, along the upper edges of area 52, to tear the case along tear line 30. As shown in the drawings, tear line 46 has a semicircular shape, although it may have other shapes as well.

Figure 5:
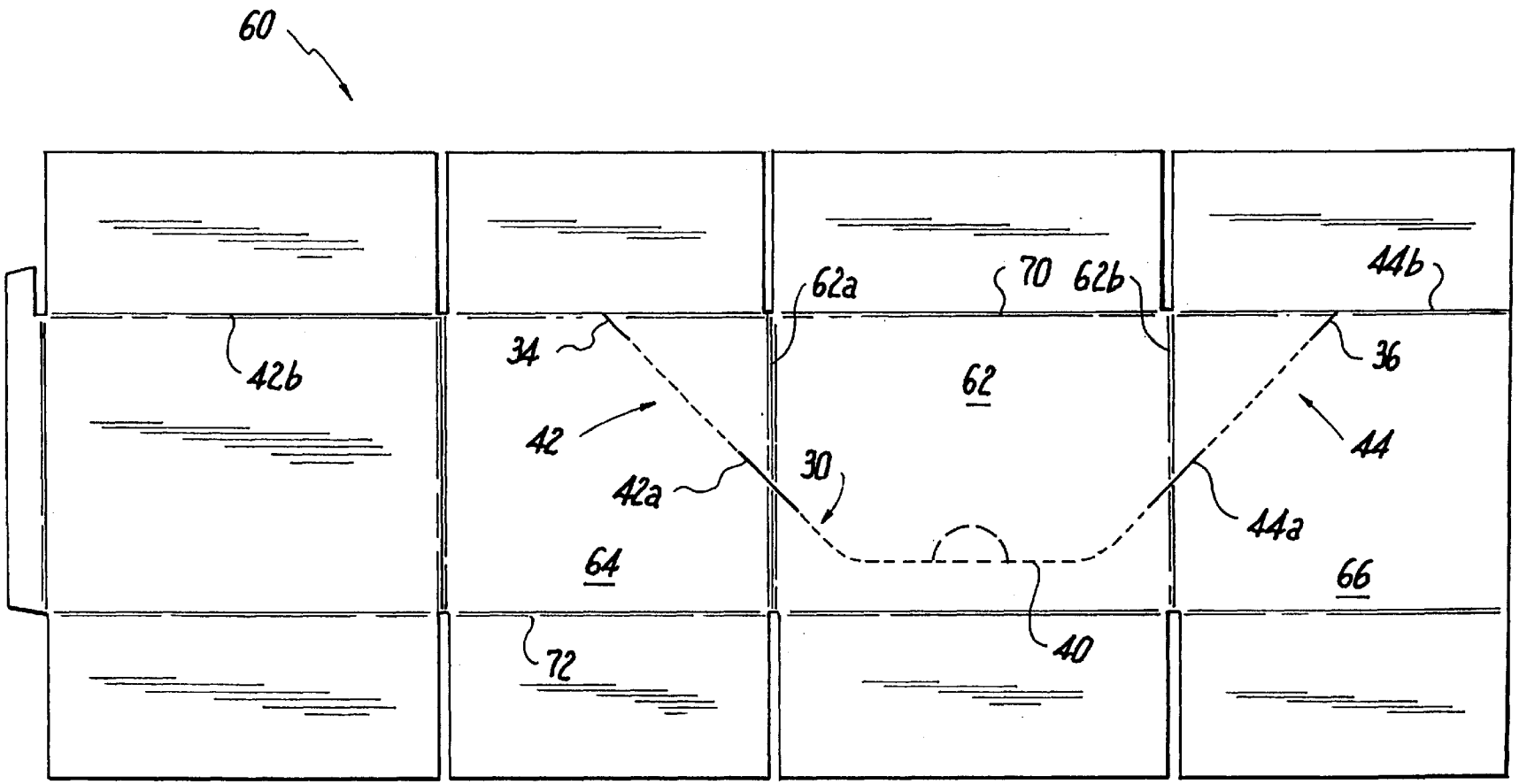
FIG. 5 is a top view of a blank that may be used to make the case of FIGS. 1–4.

FIG. 5 shows a blank 60 that may be used to manufacture case 10. Blank 60 is a flat, generally rectangular, one piece blank that has been suitably cut and scored to enable subsequent folding of the blank into the closed case 10 shown in FIGS. 1 and 2. Blank 60 includes a series of minor and major panels, including front panel 62, left panel 64, and right panel 66 that become panels 12, 16 and 20, respectively, of case 10. In blank 60, panels 62 and 64 are connected together by fold line 62*a*, and panels 62 and 66 are connected together by fold line 62*b*. Also, fold lines 70 extend across blank 60, above panels 62, 64 and 66; while fold line 72 extends across the blank, below these panels.

As clearly seen in FIG. 5, central section 40 of tear line 30 extends across front panel 62, left section 42 of the tear line extends leftwardly upwardly from the left end of section 40, across fold line 62*a* and across panel 62, and right section 44 of the tear line extends rightwardly upwardly from the right end of center section 40. Preferably, left section 42 further extends directly on fold line 70, from angled portion 34, to, or substantially to, the left edge of blank 60; and, analogously, right section 44 extends directly on fold line 70, from angled portion 36, to, or substantially to, the right edge of the blank.

With the above-described tear line 30, after the case 10 is formed from blank 60, the entire portion of the case that is above tear line 30 can be easily removed or torn away when it is desired to open the case. This allows the consumer to easily see and have access to the entire contents of the case.

Figure 4:
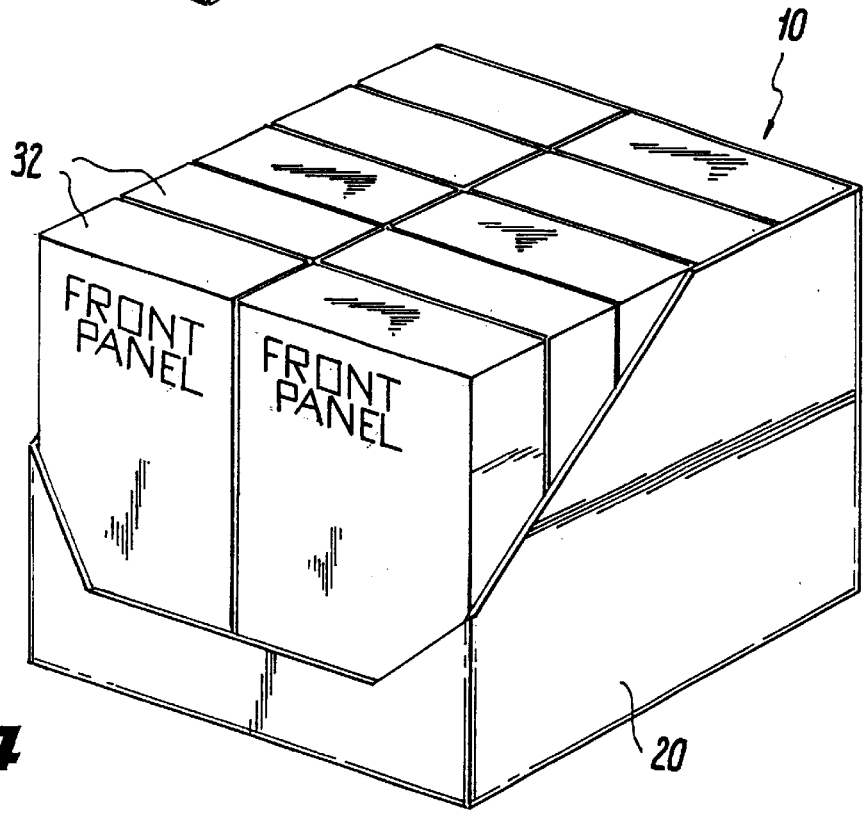
FIG. 4 shows the case, and articles inside the case, after the top f the case has been removed.

The case of the present invention may be used to hold a wide range of products or articles, represented at 32 in FIG. 4. For example, the case is very well suited for containing food products such as cereal boxes. Many other products and articles may also be used with the case.

As will be understood by those of ordinary skill in the art, case 10 and blank 60 may be made of any suitable material. For example, blank 60 may be made of various combinations of corrugated board prepared in a standard manner, or the blank can be single or double walled corrugated board also prepared in a conventional manner. In addition, tear lines 30 and 46 may be formed in any suitable way, such as by a die press. Also, with the preferred embodiment of case 10, when the case is opened, the front panels of the product 32 face the open front side of the case and can be easily seen by a consumer.

The display/shipper case of this invention has a number of important advantages. For instance, this case can be made and filled at a manufacturing facility and then shipped directly to a retail customer without requiring any re-packing or mixing. In this way, the use of the case of this invention reduces packaging costs and also saves on co-packer/re-packer costs. In addition, the case can be used, at a retail outlet, as an end-aisle display, part of a display module or as a single use case. Because of this, a single case design can be used for many sales avenues.

The design of the present invention achieves benefits associated with the use of tear lines without the normal associated disadvantages. In particular, the use of longer slits in selected portions of the tear line allows the tear line to be easily, cleanly cut or torn. At the same time, the use of shorter slits through most of the tear line results in a tear line that does not significantly reduce the structural integrity of the case, and that is resistant to premature or inadvertent opening.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A shipping and display case for containing a plurality of articles, the case comprising:

a multitude of panels connected together to form a case defining an interior for containing a plurality of articles, said multitude of panels including a front panel, a left side panel, and a right side panel; the front and left panels forming a left side edge, and the front and right side panels forming a right side edge;

wherein the front panel, the left side panel and the right side panel define a perforated tear line to facilitate opening the case to provide access to said interior;

wherein the tear line includes a multitude of slits, and the slits in selected portions of the tear line are substantially longer than the slits in the rest of the tear line to facilitate cleanly tearing the tear line across said selected portions;

wherein said selected portions includes a first portion extending upwardly across the left side edge, and a second portion extending upwardly across said right side edge; and wherein:

the tear line includes left, center, and right sections;

the center section is defined in the front panel and includes left and right ends, said left and right ends being located on the front panel and spaced from the left side edge and the right side edge respectively, the left section extends leftwardly upwardly from the left end of the center section, upwardly across a left portion of the front panel, upwardly across the left side edge and upwardly across the left side panel;

the right section extends rightwardly upwardly from the right end of the center section, upwardly across a right portion of the front panel, upwardly across the right side edge and upwardly across the right side panel; and said first portion of the tear line is in the left section, and said second portion of the tear line is in the right section.

2. A shipping and display case according to claim 1, wherein:

the left side panel includes a top left edge;

the right side panel includes a top left edge;

the left section of the tear line includes i) a first segment extending across the left side panel, ii) a second segment extending on the top left edge collinear therewith, and p2 iii) an angled portion consisting of a single continuous slit connecting together and extending between said first and second segments;

the right section of the tear line includes i) a first segment extending across the right side panel, ii) a second segment extending on the top right edge collinear therewith, and iii) an angled portion consisting of a single continuous slit extending between and connecting together said first and second segments of the right section.

3. A shipping and display case according to claim 2, wherein:

the front panel forms a cut line;

the center section of the tear line and the cut line bound an area of the front panel; and the cut line facilitates tearing away said area of the front panel to form a gripping opening therein adjacent the tear line, to help grip the front panel and tear the case open along the tear line.

4. A shipping and display case according to claim 1, wherein in each of the selected portions of the tear line, the tear line consists of a single slit.

5. A shipping and display case according to claim 1, wherein:

the multitude of panels furthers include a top panel and a back panel, said top and back panels being connected together along a back, top edge, and the tear line extends completely across said back, top edge to facilitate completely removing a top of the case.

6. A shipping and display case according to claim 5, wherein the center sections of the tear line is formed by a series of slits one half inch long and spaced apart three sixteenths of an inch;

the first segment of the left and right sections of the tear line are formed by a series of slits one half inch long and spaced apart three-sixteenths of an inch.

7. A shipping and display case according to claim 6, wherein the second segments of the left and right section so the tear line and formed by a series of slits three-eights of an inch long and spaced apart one quarter inch.

8. A blank for forming a shipping and display case for containing a plurality of articles, the blank comprising: a multitude of panels integrally connected together, and adapted to be folded and connected together to form a case defining an interior for containing a plurality of articles, said multitude of panels including a front panel, a left side panel, and a right side panel, the front and left side panels being connected together by a left fold line, and the front and right side panels being connected together by a right fold line;

wherein the front panel, the left side panel and the right side panel define a perforated tear line to facilitate opening the case to provide access to said interior;

wherein the tear line includes a multitude of slits, and the slits in selected portions of the tear line are substantially longer than the slits in the rest of the tear line to facilitate cleanly tearing the tear line across said selected portions; and wherein said selected portions include first portion extending across the left fold line, and a second portion extending across said right fold line; and wherein the tear line includes left, center, and right sections;

the center section is defined in the front panel and includes left and right ends, said left and right ends being located on the front panel and spaced from the left side edge and the right side edge respectively;

the left section extends leftwardly upwardly from the left end of the center section, upwardly across a left portion of the front panel, upwardly across the left fold line and upwardly across the left side panel;

the right section extends rightwardly upwardly from the right end of the center section, upwardly across a right portion of the front panel, upwardly across the right fold line and across the right side panel; and said first portion of the tear line is in the left section and said second portion of the tear line is in the right section.

9. A blank according to claim 8, wherein:

the left side panel includes a top left edge;

the right side panel includes a top right edge;

the left section of the tear line includes i) a first segment extending across the left side panel, ii) a second segment extending on the top left edge collinear therewith, and iii) an angled portion consisting of a single continuous slit connecting together and extending between said first and second segments;

the right section of the tear line includes i) a first segment extending across the right side panel, ii) a second segment extending on the top right edge collinear therewith, and iii) an angled portion consisting of a single continuous slit extending between and connecting together said first and second segments of the right section.

10. A blank according to claim 9, wherein:

the front panel forms a cut line;

the center section of the tear line and the cut line bound an area of the front panel; and the cut line facilitates tearing away said area of the front panel to form a gripping opening therein adjacent the tear line, to help grip the front panel and tear the case open along the tear line.

11. A blank according to claim 8, wherein in each of the selected portions of the tear line the tear line consists of a single slit.

12. A blank according to claim 8, wherein:

the multitude of panels further includes a top panel and a back panel, said toi and back panels being connected together along a back, top edge, and the tear line extends completely across said back, top edge to facilitate completely removing a top of the case.

13. A blank according to claim 12, wherein:

the center sections of the tear line is formed by a series of slits one half inch long and spaced apart three-sixteenths of an inch;

the first segment of the left and right sections of the tear line are formed by a series of slits one half inch long and spaced apart three-sixteenths of an inch.

14. A blank according to claim 13, wherein the second segments of the left and the right sections of the tear line are formed by a series of slits three-eights of an inch long and spaced apart one quarter inch.

* * * * *